US009514872B2

(12) United States Patent
Rallabandi et al.

(10) Patent No.: US 9,514,872 B2
(45) Date of Patent: Dec. 6, 2016

(54) ELECTROMAGNETIC ACTUATOR AND METHOD OF USE

(71) Applicant: General Electric Company, Schenectady, NY (US)

(72) Inventors: Vandana Rallabandi, Karnataka (IN); Srinivas Satya Sai Mallampalli, Karnataka (IN); Ravindra Shyam Bhide, Karnataka (IN)

(73) Assignee: General Electric Company, Niskayuna, NY (US)

( * ) Notice: Subject to any disclaimer, the term of this patent is extended or adjusted under 35 U.S.C. 154(b) by 19 days.

(21) Appl. No.: 14/576,677

(22) Filed: Dec. 19, 2014

(65) Prior Publication Data

US 2016/0181049 A1 Jun. 23, 2016

(51) Int. Cl.
*H01F 3/00* (2006.01)
*H01F 7/16* (2006.01)
(Continued)

(52) U.S. Cl.
CPC ..... *H01F 7/16* (2013.01); *H01F 7/0278* (2013.01); *H01F 7/081* (2013.01);
(Continued)

(58) Field of Classification Search
CPC ..... H01F 7/122; H01F 7/1615; H01F 7/1646; H01H 2051/2218; H01H 51/2209; Y10T 29/49075
See application file for complete search history.

(56) References Cited

U.S. PATENT DOCUMENTS 5,452,172 A 9/1995 Lane et al.
5,646,588 A * 7/1997 Cannon ..... H01F 7/1646 335/276
(Continued)

FOREIGN PATENT DOCUMENTS

CN 100517522 C 7/2009
EP 1665295 B1 5/2008
(Continued)

OTHER PUBLICATIONS

Vogel, Oliver, and Jürgen Ulm. "Theory of Proportional Solenoids and Magnetic Force Calculation Using COMSOL Multiphysics." ComSol-User Conference Ludwigsburg. vol. 27. No. 28.10. 2011.
(Continued)

*Primary Examiner* — Bernard Rojas
(74) *Attorney, Agent, or Firm* — Nitin N. Joshi

(57) ABSTRACT

An electromagnetic actuator includes a plunger, an armature, and a coil. The plunger is moveable between a first position and a second position. The armature includes a first armature portion proximally disposed about the first position, and a second armature portion proximally disposed about the second position. The coil is proximally disposed with the first armature portion and, when energized, is configured to generate a magnetic field. The magnetic field causes the plunger to move toward the first position by a magnetic flux through a magnetic circuit. The magnetic circuit includes the first armature portion, the plunger, a main air gap, and a variable air gap. The main air gap and variable air gap are between the first armature portion and the plunger. The main air gap diminishes as the plunger moves toward the first position. The variable air gap enlarges as the plunger moves toward the first position.

18 Claims, 4 Drawing Sheets

(51) Int. Cl.

| | |
|---|---|
| ***H01F 7/02*** | (2006.01) |
| ***H01F 7/08*** | (2006.01) |
| ***H01H 33/666*** | (2006.01) |
| *H01H 33/38* | (2006.01) |

(52) U.S. Cl.
CPC ... *H01H 33/6662* (2013.01); *H01F 2007/086* (2013.01); *H01F 2007/1692* (2013.01); *H01H 33/38* (2013.01)

(56) References Cited

U.S. PATENT DOCUMENTS

| | | | | |
|---|---|---|---|---|
| 6,950,000 | B1 | 9/2005 | Lanni et al. | |
| 7,982,567 | B2 | 7/2011 | Cartier Millon et al. | |
| 8,237,527 | B2 * | 8/2012 | An | H01F 7/066 310/12.24 |
| 8,729,984 | B2 | 5/2014 | Feller et al. | |
| 2010/0164661 | A1 * | 7/2010 | Sohn | H01F 7/1615 335/229 |
| 2012/0261499 | A1 | 10/2012 | Dames | |

FOREIGN PATENT DOCUMENTS

| | | | |
|---|---|---|---|
| WO | 9001788 | A1 | 2/1990 |
| WO | 03030188 | A1 | 4/2003 |

OTHER PUBLICATIONS

"ElectroMagnetic Actuator Basics," HydraForce, pp. 39-52, retrieved from website www.hydraforce.com/svtraining/files/weiuhe_Chap4.pdf.

* cited by examiner

ELECTROMAGNETIC ACTUATOR AND METHOD OF USE

BACKGROUND

The field of the disclosure relates generally to electromagnetic actuators and, more particularly, to an electromagnetic actuator with multiple air gaps and pole shaping and a method of use.

Most known electromagnetic actuators convert electric power into magnetic force to move a push pin. The push pin is coupled to a plunger that moves freely within a cavity in the actuator, generally within a guiding structure. Current passes through a coil in the electromagnetic actuator and generates an electromagnetic field and, more specifically, an electromagnetic flux.

For many of these known electromagnetic actuators, certain surfaces of the plunger operate as poles that are attracted to the electromagnetic flux, pulling the plunger toward the coil. A flux circuit is formed around the coil by the plunger, the poles, and a yoke. An air gap between the poles and the yoke dictates the magnetic force with which the plunger is pulled toward the coil. The air gap is a region of high magnetic reluctance, which can be air, a vacuum, or another non-magnetic material. The push pin transfers the magnetic force to an external object. When the plunger reaches a stable position, the plunger is latched in place by one or more permanent magnets.

Such known electromagnetic actuators often replace mechanical spring mechanisms in various applications. A force-stroke relationship, which is frequently represented as a force-stroke curve, for a spring does not always meet the requirements of a given application, for example, and without limitation, a vacuum circuit breaker. Electromagnetic actuators have a force-stroke relationship that matches the mechanical characteristics of vacuum circuit breakers. Electromagnetic actuators are also available at a lower cost, require less maintenance, have a reduced footprint, and greater endurance. However, certain applications, e.g., certain vacuum circuit breakers, call for unique force-stroke relationships depending on the stroke direction. For vacuum circuit breakers, a closing force-stroke curve and an opening force-stroke curve are often different. Additionally, some vacuum circuit breakers also utilize a spring effect of the contacts themselves to achieve a desired force-stroke curve.

BRIEF DESCRIPTION

In one aspect, an electromagnetic actuator is provided. The electromagnetic actuator includes a plunger, a first yoke portion, a second yoke portion, and a coil. The plunger is moveable between a first position and a second position. The first yoke portion is proximally disposed about the first position, and the second yoke portion is proximally disposed about the second position. The coil is proximally disposed with the first yoke portion and, when energized, is configured to generate a magnetic field. The magnetic field causes the plunger to move toward the first position by a magnetic flux through a magnetic circuit. The magnetic circuit includes the first yoke portion, the plunger, a first air gap, and a variable air gap. The first air gap and variable air gap are at least partially defined by the first yoke portion and the plunger. The first air gap diminishes as the plunger moves toward the first position. The variable air gap enlarges as the plunger moves toward the first position.

In another aspect, a method of operating an electromagnetic actuator is provided. The method includes latching a plunger in a position. The method also includes energizing a first coil to generate a first magnetic flux. The magnetic flux flows through the plunger, a first yoke portion, a first air gap, and a variable air gap. The method also includes generating an electromotive force corresponding to the first magnetic flux. The electromotive force is applied to the plunger, causing the plunger to travel toward the first yoke portion. The method also includes reducing a length of the first air gap and enlarging a cross-section of the variable air gap to regulate the electromotive force upon the plunger.

In yet another aspect, a vacuum circuit breaker is provided. The vacuum circuit breaker includes a first contact, a second contact, and an electromagnetic actuator. The second contact is configured to translate between an open position and a closed position in which the second contact is further configured to engage the first contact. The electromagnetic actuator includes a plunger, a first yoke, a second yoke, and an opening coil. The plunger includes at least one permanent magnet and is coupled to the second contact. The plunger is moveable between the open position and the closed position. The first yoke is proximally disposed about the closed position. The second yoke is proximally disposed about the open position. The opening coil is proximally disposed with the second yoke. When energized, the opening coil is configured to generate an opening magnetic field that causes the plunger to move toward the open position. The opening coil is further configured to generate an opening magnetic flux through an opening magnetic circuit. The opening magnetic circuit includes the second yoke, the plunger, a first air gap, and a variable air gap. The first air gap and variable air gap are defined at least partially by the second yoke and the plunger. The first air gap is configured to diminish as the plunger moves toward the open position. The variable air gap is configured to enlarge as the plunger moves toward the open position. The plunger moves toward the open position with an opening force corresponding to the first air gap and the variable air gap.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise The electromagnetic actuators described herein provide unique pole shaping that facilitates unique force-stroke relationships depending on the stroke direction. More specifically, the embodiments of electromagnetic actuators described herein include multiple air gaps for storing magnetic energy. Pole shaping is a process by which surfaces of the electromagnetic actuator plunger and yoke that define an air gap are configured to form a particular air gap. One or more of the multiple air gaps may vary with stroke, facilitating custom force-stroke relationships. Some of the electromagnetic actuators described herein include permanent magnetics disposed in the mobile portion of the actuator, further facilitating variable air gaps.

Figure 1:
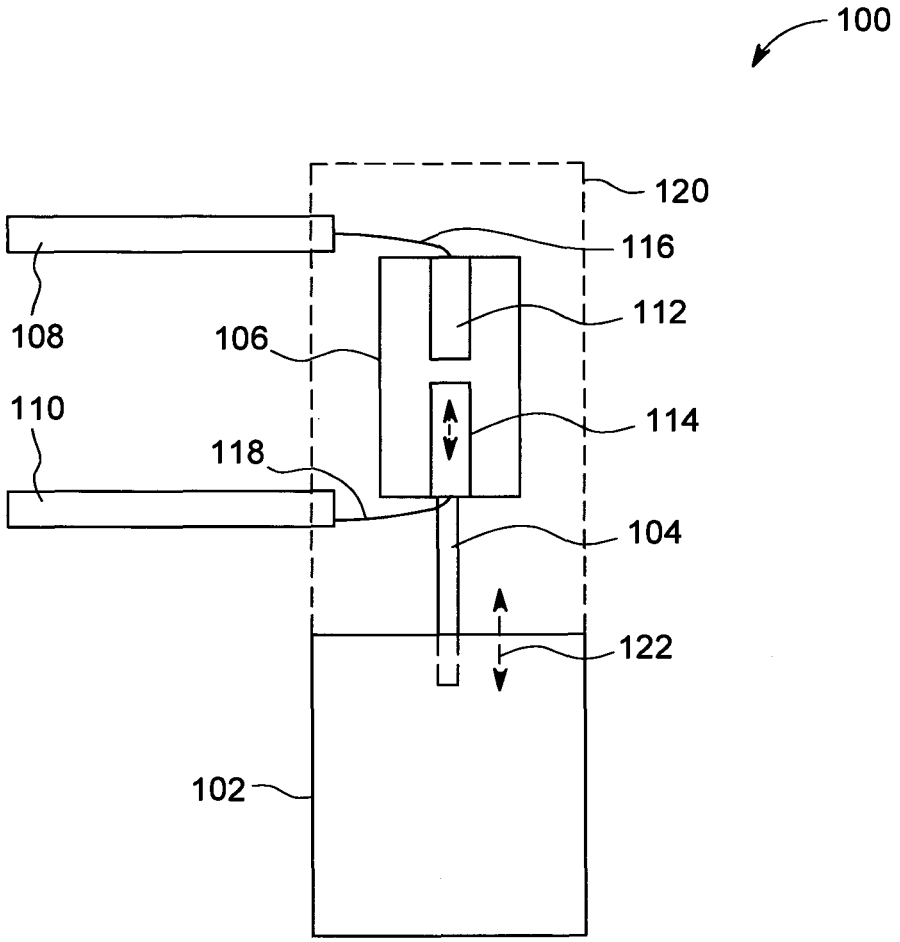
FIG. 1 is a cross-sectional diagram of an exemplary vacuum circuit breaker.

FIG. 1 is a cross-sectional diagram of an exemplary vacuum circuit breaker 100. Vacuum circuit breaker 100 includes an electromagnetic actuator 102, a push pin 104, a vacuum cylinder 106, and terminals 108 and 110. Vacuum cylinder 106 includes a first contact 112 and a second contact 114. First contact 112 is electrically coupled to terminal 108 by a terminal interface 116. Second contact 114 is electrically coupled to terminal 110 by a terminal interface 118. Vacuum cylinder 106, push pin 104, and terminal interfaces 116 and 118 are contained within a vacuum circuit breaker body 120.

Electromagnetic actuator 102 has a linear range of travel, i.e., a stroke 122, that translates push pin 104 up and down. As push pin 104 translates up and down, terminals 108 and 110 are coupled and decoupled, respectively. When terminals 108 and 110 are coupled, vacuum circuit breaker 100 is closed. Conversely, when terminals 108 and 110 are decoupled, vacuum circuit breaker 100 is open.

Figure 2:
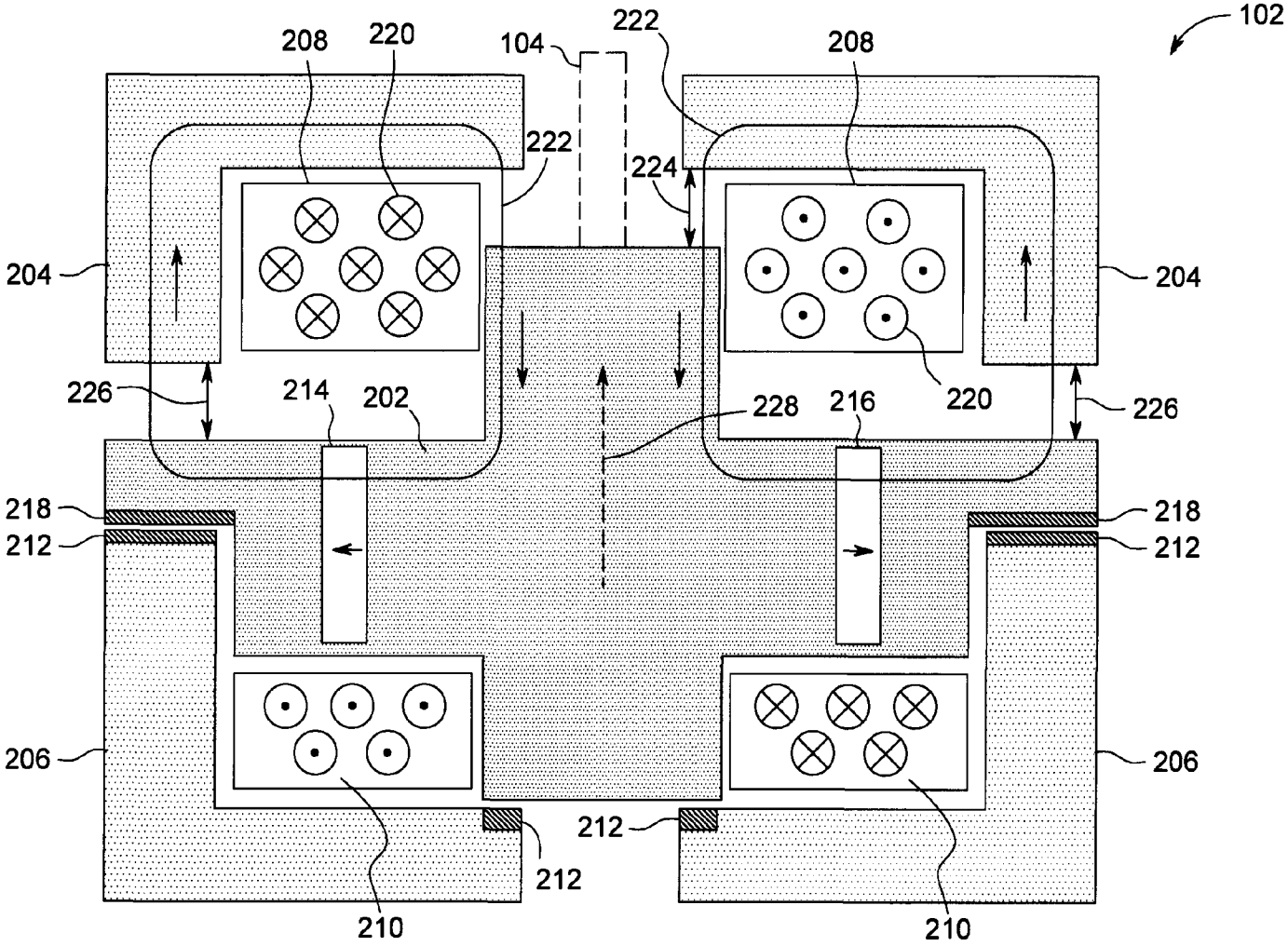
FIG. 2 is a cross-sectional diagram of an exemplary electromagnetic actuator that may be used with the vacuum circuit breaker shown in FIG. 1, illustrated in a stable position.

FIG. 2 is a cross-sectional diagram of the exemplary electromagnetic actuator 102 (shown in FIG. 1). Electromagnetic actuator 102 includes a plunger 202 coupled to push pin 104 (also shown in FIG. 1) and disposed within a first yoke portion 206 and a second yoke portion 204. Electromagnetic actuator 102 also includes a first coil 210 and a second coil 208. First yoke portion 206 includes poles 212. Plunger 202 includes permanent magnets 214 and 216, and poles 218.

Electromagnetic actuator 102 is illustrated in a stable position. More specifically, plunger 202 is latched by permanent magnets 214 and 216 in a first position near first yoke portion 206. Plunger 202 is also latchable by permanent magnets 214 and 216 in a second position near second yoke portion 204.

Second coil 208 is energized to move plunger 202 from the first position to the second position. As illustrated, energizing second coil 208 pulls plunger 202 up toward second yoke portion 204. When energized, a second-coil current 220 flows through windings of second coil 208. Second-coil current 220 generates an electromagnetic field (not shown) and, more specifically, creates a second magnetic circuit 222. A direction of second-coil current 220 is configured such that a direction of the magnetic field is aligned with an orientation of permanent magnets 214 and 216, thus avoiding demagnetizing permanent magnets 214 and 216. Second-coil current 220 flows out of the page on the right side of second coil 208, indicated by circles and solid dots. Second-coil current 220 flows into the page on the left side of second coil 208, indicated by circles and Xs. The direction of second-coil current 220 results in a clockwise magnetic flux direction on the left side of second magnetic circuit 222 and a counter-clockwise magnetic flux direction on the right side of second magnetic circuit 222.

Second magnetic circuit 222 includes second yoke portion 204, plunger 202, a second primary air gap 224, and a second secondary air gap 226. Second yoke portion 204 and plunger 202 at least partially define second primary air gap 224 and second secondary air gap 226. The magnetic field resulting from energizing second coil 208 is strong and concentrated in second yoke portion 204 and plunger 202 due to their respective low reluctances. Second primary air gap 224 and second secondary air gap 226 have a high reluctance relative to second yoke portion 204 and plunger 202. Consequently, second primary air gap 224 and second secondary air gap 226 store most of the magnetic energy of the generated magnetic field and impact the amount of magnetic flux through second magnetic circuit 222. The amount of magnetic flux is directly related to an electromotive force 228 applied to plunger 202. The amount of magnetic flux is inversely related to squares of respective lengths of second primary air gap 224 and second secondary air gap 226. Therefore, as the respective lengths of second primary air gap 224 and second secondary air gap 226 decrease, electromotive force 228 applied to plunger 202 increases. As plunger 202 moves, under electromotive force 228, toward second yoke portion 204, the respective lengths of second primary air gap 224 and second secondary air gap 226 decrease, and electromotive force 228 increases. Likewise, electromotive force 228 decreases as the respective lengths of second primary air gap 224 and second secondary air gap 226 increase, which occurs when plunger 202 moves toward first yoke portion 206.

Figure 3:
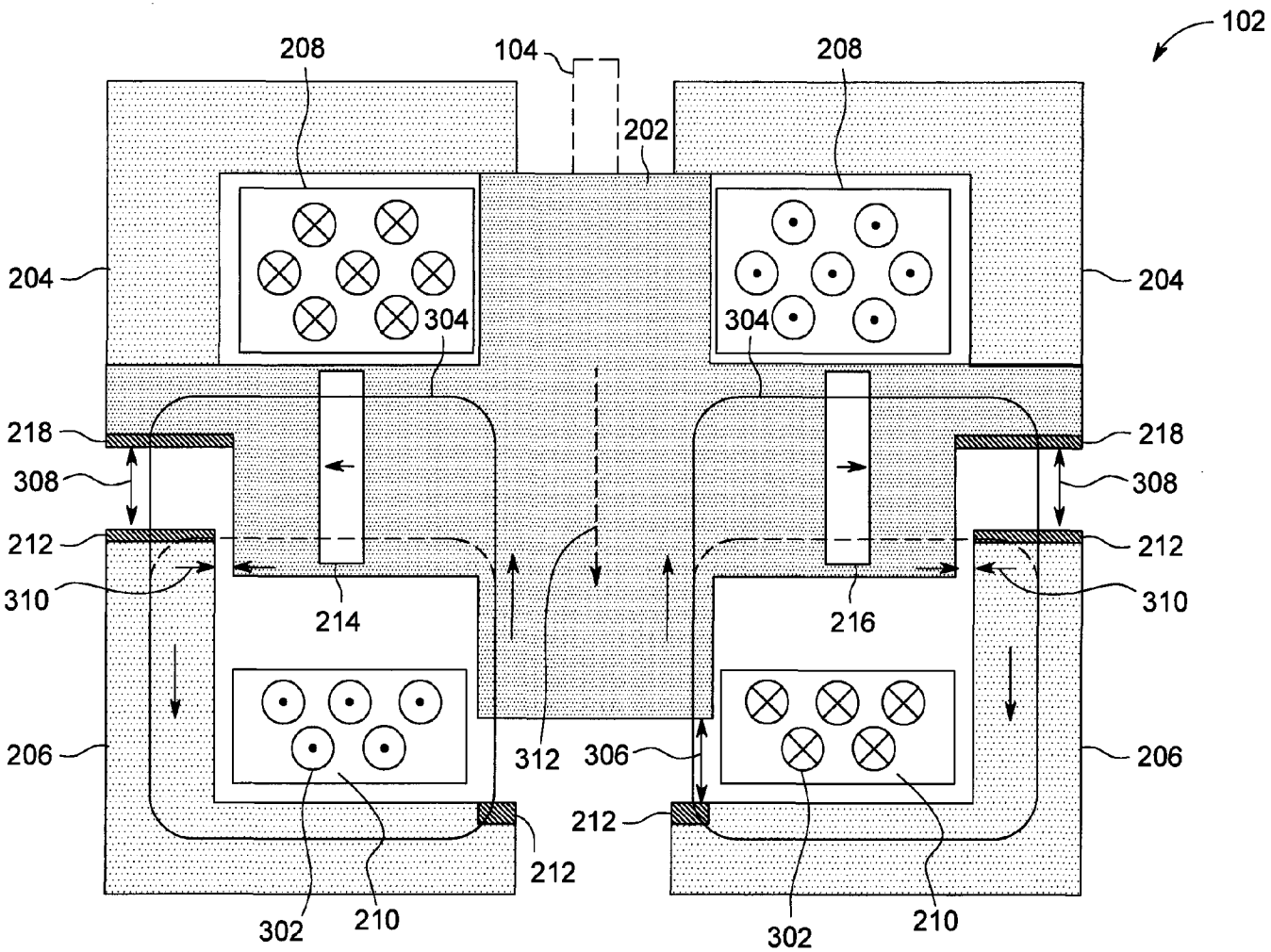
FIG. 3 is a cross-sectional diagram of an exemplary electromagnetic actuator that may be used with the vacuum circuit breaker shown in FIG. 1, illustrated in another stable position.

FIG. 3 is a cross-sectional diagram of electromagnetic actuator 102 (shown in FIG. 1) illustrated with plunger 202 in the second position near second yoke portion 204. Permanent magnets 214 and 216 latch plunger 202 in the second position. First coil 210 is energized to move plunger 202 from the second position near second yoke portion 204 to the first position near first yoke portion 206. When first coil 210 is energized, a first-coil current 302 flows through first coil 210 in a direction such that a corresponding magnetic field is aligned with the orientation of permanent magnets 214 and 216. First-coil current 302 flows out of the page on the left side of first coil 210, indicated by the circles and solid dots, and flows into the page on the right side of first coil 210, indicated by the circles and Xs. First-coil current 302 generates an electromagnetic field and, more specifically, creates a first magnetic circuit 304. The direction of first-coil current 302 results in a counter-clockwise magnetic flux on the left side of first magnetic circuit 304 and a clockwise magnetic flux on the right side of first magnetic circuit 304.

First magnetic circuit 304 includes first yoke portion 206, plunger 202, a first primary air gap 306, a first secondary air gap 308, and a variable air gap 310. First primary air gap 306 is formed at the center of plunger 202, between plunger 202 and poles 212 of first yoke portion 206. First secondary air gap 308 is formed at the periphery of plunger 202, between poles 218 of plunger 202 and poles 212 of first yoke portion 206. Variable air gap 310 is formed tangentially to plunger 202, between plunger 202 and an interior surface of first yoke portion 206.

The magnetic field resulting from energizing first coil 210 is strong and concentrated in first yoke portion 206 and plunger 202 due to their respective low reluctances. First primary air gap 306, first secondary air gap 308, and variable air gap 310 have high reluctances relative to first yoke portion 206 and plunger 202. Consequently, first air gap 306, second air gap 308, and variable air gap 310 store most of the magnetic energy of the generated magnetic field and impact the amount of magnetic flux through first magnetic circuit 304. The amount of magnetic flux is directly related to an electromotive force 312 applied to plunger 202.

The amount of magnetic flux through first magnetic circuit 304 is inversely related to the size of first primary air gap 306, first secondary air gap 308, and variable air gap 310. As plunger 202 moves, due to electromotive force 312, toward first yoke portion 206, respective lengths of first primary air gap 306 and first secondary air gap 308 decrease until poles 218 and plunger 202 meet poles 212, which increases the magnetic flux. As first primary air gap 306 and first secondary air gap 308 reduce in size, variable air gap 310 increases in size, which stores magnetic energy and reduces the amount of magnetic flux through first magnetic circuit 304. Plunger 202, poles 218, and poles 212 are configured to form variable air gap 310 as a variable air gap that facilitates a customizable force-stroke relationship for electromagnetic actuator 102. Moreover, the customizable force-stroke relationship is different per direction of travel of plunger 202.

Figure 4:
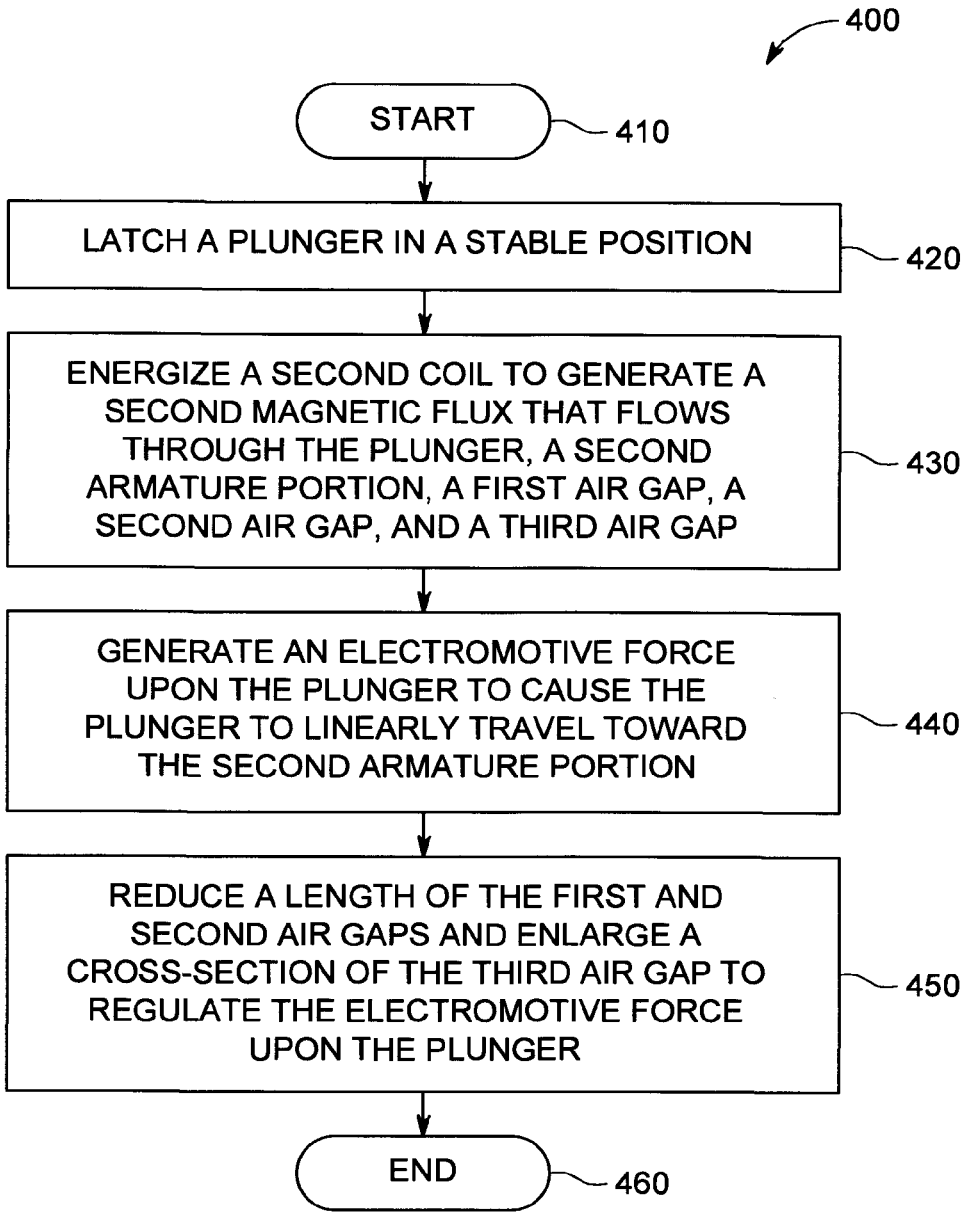
FIG. 4 is a flow diagram of an exemplary method of operating an electromagnetic actuator shown in FIGS. 2 and 3.

FIG. 4 is a flow diagram of an exemplary method 400 of operating electromagnetic actuator 102 (shown in FIG. 1). Method 400 begins at a start step 410. At a latching step 420, plunger 202 of electromagnetic actuator 102 (shown in FIGS. 2 and 3) is latched in a stable position by permanent magnets 214 and 216 (also shown in FIGS. 2 and 3). At an energizing step 430, first coil 210 (shown in FIGS. 2 and 3) is energized, generating a magnetic flux through first magnetic circuit 304 (shown in FIG. 3). First magnetic circuit 304 passes through plunger 202, first yoke portion 206, first primary air gap 306, first secondary air gap 308, and variable air gap 310 (all shown in FIG. 3).

At a translation step 440, the magnetic flux through first magnetic circuit 304 generates electromotive force 312 (shown in FIG. 3) upon plunger 202. Plunger 202 then travels linearly toward first yoke portion 206. In an air gap varying step 450, as plunger 202 travels toward first yoke portion 206, lengths of first primary air gap 306 and first secondary air gap 308 are reduced. As plunger 202 travels toward first yoke portion 206, a cross-section of variable air gap 310 increases. The variance in air gap size facilitates regulation of electromotive force 312 upon plunger 202 by regulating the amount of flux through first magnetic circuit 304.

In certain embodiments, plunger 202 is locked in another stable position near first yoke portion 206 by permanent magnets 214 and 216. When second coil 208 is energized, a magnetic flux is generated through second magnetic circuit 222 (all shown in FIG. 2). Second magnetic circuit 222 passes through second yoke portion 204, plunger 202, second primary air gap 224, and second secondary air gap 226 (all shown in FIG. 2). The magnetic flux generates electromotive force 228 (shown in FIG. 2) upon plunger 202. Electromotive force 228 pulls plunger 202 linearly toward second yoke portion 204, closing second primary air gap 224 and second secondary air gap 226. The method then ends at an end step 460.

The above-discussed electromagnetic actuators provide unique pole shaping that facilitates unique force-stroke relationships depending on the stroke direction. More specifically, the embodiments of electromagnetic actuators described herein include multiple air gaps for storing magnetic energy. One or more of the multiple air gaps may vary with stroke, facilitating custom force-stroke relationships. Some of the electromagnetic actuators described herein include permanent magnetics disposed in the mobile portion of the actuator, further facilitating variable air gaps.

An exemplary technical effect of the methods, systems, and apparatus described herein includes at least: (a) an electromagnetic actuator having unique force-stroke relationships achieved through multiple air gaps, at least one of which is a variable air gap formed by pole shaping; (b) a reduced foot-print relative to mechanical spring mechanisms; and (c) a reduced cost over mechanical spring mechanisms.

Exemplary embodiments of methods, systems, and apparatus for electromagnetic actuators are not limited to the specific embodiments described herein, but rather, components of systems and/or steps of the methods may be utilized independently and separately from other components and/or steps described herein. For example, the methods may also be used in combination with other non-conventional electromagnetic actuators, and are not limited to practice with only the systems and methods as described herein. Rather, the exemplary embodiment can be implemented and utilized in connection with many other applications, equipment, and systems that may benefit from unique force-stroke relationships.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electromagnetic actuator comprising:

a plunger moveable between a first position and a second position;

a yoke comprising a first yoke portion proximate the first position and a second yoke portion proximate the second position; and a first coil proximally disposed with said first yoke portion, said first coil configured to generate a first magnetic field when energized, the first magnetic field causing said plunger to move toward the first position, said first coil further configured to generate a first magnetic flux through a first magnetic circuit, said first magnetic circuit comprising:

said first yoke portion;

said plunger;

a first primary air gap at least partially defined by said first yoke portion and said plunger, said first primary air gap configured to diminish as said plunger moves toward the first position;

a first secondary air gap at least partially defined by said first yoke portion and said plunger, said first secondary air gap configured to diminish as said plunger moves toward the first position; and a variable air gap at least partially defined by said first yoke portion and said plunger, said variable air gap having a cross-section configured to enlarge as said plunger moves toward the first position, wherein enlarging the cross-section of the variable air gap includes linearly translating the plunger perpendicular to a length dimension between the plunger and the first yoke portion.

2. The electromagnetic actuator in accordance with claim 1 further comprising a plurality of permanent magnets disposed within said plunger and configured to latch said plunger when in the first position and when in the second position.

3. The electromagnetic actuator in accordance with claim 1 further comprising a second coil proximate said second yoke portion and, when energized, said second coil is configured to generate a second magnetic field that causes said plunger to move toward the second position, said second coil further configured to generate a second magnetic flux through a second magnetic circuit, said second magnetic circuit comprising:

said second yoke portion;

said plunger;

a first secondary air gap at least partially defined by said second yoke portion and said plunger, said first secondary air gap configured to diminish as said plunger moves toward the second position; and a second secondary air gap at least partially defined by said second yoke portion and said plunger, said second secondary air gap configured to diminish as said plunger moves toward the second position.

4. The electromagnetic actuator in accordance with claim 1, wherein said plunger and said first yoke portion are coupled to a plurality of poles disposed to at least partially define said first primary air gap, said first secondary air gap, and said variable air gap.

5. The electromagnetic actuator in accordance with claim 4, wherein said plunger, said first yoke portion, and said plurality of poles comprise a ferromagnetic material.

6. The electromagnetic actuator in accordance with claim 1, wherein said variable air gap comprises a non-ferrous material.

7. The electromagnetic actuator in accordance with claim 1, wherein said first primary air gap and first secondary air gap diminish at a same rate as the cross-section of said variable air gap enlarges, causing a net-zero change in the first-magnetic flux through said magnetic circuit.

8. The electromagnetic actuator in accordance with claim 1, wherein said first primary air gap defines a first length between said first yoke portion and said plunger and said first secondary air gap defines a second length between said first yoke portion and said plunger, and wherein said first length and said second length are configured to diminish as said plunger moves toward the first position.

9. A method of operating an electromagnetic actuator including a plunger movable between a first position and a second position, the electromagnetic actuator including an armature including a first yoke portion proximate the first position and a second yoke portion proximate the second position, said method comprising:

latching the plunger in the second position;

energizing a first coil to generate a first magnetic flux through the plunger, the first yoke portion, a first primary air gap, a first secondary air gap, and a variable air gap;

generating a first electromotive force, corresponding to the first magnetic flux, upon the plunger, causing the plunger to travel toward the first yoke portion; and reducing a first length of the first primary air gap, reducing a second length of the first secondary air gap, and enlarging a cross-section of the variable air gap to regulate the electromotive force upon the plunger, wherein enlarging the cross-section of the variable air gap comprises linearly translating the plunger perpendicular to a length dimension between the plunger and the first yoke portion.

10. The method in accordance with claim 9, wherein latching the plunger comprises employing at least one permanent magnet in the plunger to latch the plunger to the second yoke portion.

11. The method in accordance with claim 9, wherein energizing the first coil to generate the first magnetic flux comprises generating the first magnetic flux at least partially as a function of a size of the variable air gap, said variable air gap at least partially defined by the plunger and the first yoke portion.

12. The method in accordance with claim 9, wherein energizing the first coil comprises applying a voltage to the first coil.

13. The method in accordance with claim 9 further comprising:

latching the plunger in the first position;

energizing a second coil to generate a second magnetic flux through the plunger, the second yoke portion, a second primary air gap, and a second secondary air gap, each of the second primary air gap and the second secondary air gap at least partially defined by the second yoke portion and the plunger;

generating a second electromotive force, corresponding to the second magnetic flux, upon the plunger, causing the plunger to linearly travel toward the second yoke portion; and reducing a first length of the second primary air gap and a second length of the second secondary air gap to regulate the second electromotive force upon the plunger.

14. A vacuum circuit breaker comprising:

a first contact;

a second contact configured to translate between an open position and a closed position in which said second contact is further configured to engage said first contact; and an electromagnetic actuator comprising:

a plunger coupled to said second contact and moveable between the open position and the closed position, wherein said plunger comprises at least one permanent magnet;

a first yoke proximally disposed about the open position;

a second yoke proximally disposed about the closed position; and an opening coil proximally disposed with said first yoke and, when energized, said opening coil configured to generate an opening magnetic field that causes said plunger to move toward the open position, said opening coil further configured to generate an opening magnetic flux through an opening magnetic circuit, said opening magnetic circuit comprising:

said first yoke;

said plunger;

a first primary air gap at least partially defined by said first yoke and said plunger, said first primary air gap configured to diminish as said plunger moves toward the open position with an opening force;

a first secondary air gap at least partially defined by said first yoke and said plunger, said first secondary air gap configured to diminish as said plunger moves toward the open position with the opening force; and a variable air gap at least partially defined by said first yoke and said plunger, said variable air gap having a cross-section configured to enlarge as said plunger moves toward the open position with the opening force, wherein enlarging the cross-section of the variable air gap includes linearly translating the plunger perpendicular to a length dimension between the plunger and the first yoke portion and wherein the opening force is at least partially a function of said first primary air gap, said first secondary air gap, and said variable air gap.

15. The vacuum circuit breaker in accordance with claim 14, wherein said opening magnetic circuit further comprises said at least one permanent magnet disposed in said plunger.

16. The vacuum circuit breaker in accordance with claim 14, wherein the opening force varies linearly with displacement of said plunger from the closed position.

17. The vacuum circuit breaker in accordance with claim 14, wherein said electromagnetic actuator further comprises a closing coil proximally disposed with said second yoke and, when energized, said closing coil is configured to generate a closing magnetic field that causes said plunger to move toward the closed position, said closing coil further configured to generate a closing magnetic flux through a closing magnetic circuit, said closing magnetic circuit comprising:

said first yoke;

said plunger;

a second primary air gap at least partially defined by said second yoke and said plunger; and a second secondary air gap at least partially defined by said second yoke and said plunger, said second secondary air gap configured to diminish as said plunger moves toward the closed position with a closing force, the closing force at least partially a function of said second primary air gap and said second secondary air gap.

18. The vacuum circuit breaker in accordance with claim 17, wherein said opening coil comprises fewer turns than said closing coil.

* * * * *